US005708241A

United States Patent [19]

Lin

[11] Patent Number: 5,708,241

[45] Date of Patent: Jan. 13, 1998

[54] POSITIONING STRUCTURE FOR A SLIDING TYPE SWITCH ASSEMBLY

[76] Inventor: Chao-Chin Lin, No. 2, Jin-Chein 4th Street, Taichung, Taiwan

[21] Appl. No.: 719,432

[22] Filed: Sep. 25, 1996

[51] Int. Cl.[6] ..... H01H 15/00; H01H 1/36

[52] U.S. Cl. ..... 200/16 C; 200/252

[58] Field of Search ..... 200/260, 16 R, 200/16 C, 16 D, 11 TW, 11 R, 275, 237, 537–550, 252

[56] References Cited

U.S. PATENT DOCUMENTS

| | | | |
|---|---|---|---|
| 1,801,611 | 4/1931 | Norviel | 200/16 C |
| 4,121,062 | 10/1978 | Fujino | 200/16 D |
| 4,698,613 | 10/1987 | Okuya | 200/16 C |
| 4,825,020 | 4/1989 | Rao et al. | 200/16 D |
| 5,532,442 | 7/1996 | Lin | 200/16 C |

FOREIGN PATENT DOCUMENTS

| | | | |
|---|---|---|---|
| 2310716 | 9/1974 | Germany | 200/16 C |

*Primary Examiner*—Peter S. Wong
*Assistant Examiner*—Bao Q. Vu
*Attorney, Agent, or Firm*—Charles E. Baxley, Esq.

[57] ABSTRACT

A sliding type switch includes a non-conductive housing enclosing chamber. A non-conductive board is securely mounted in an upper portion of the chamber and includes at least three pairs of slots defined therein. At least three pairs of conductive prongs respectively extend through the slots in the board, each conductive prong having a conductive shoe formed at a bottom thereof. A non-conductive slide member is slidably mounted in a lower portion of the chamber. The slide member defines two elongated troughs in which an inner bottom wall defining each elongated trough has a stub formed thereon. An elastic element is mounted in each trough and includes a mediate portion with a hole defined therein through which the associated stub extends for positioning the elastic element, and a first limb and a second limb which extend upwardly from the mediate portion and away from each other. At least one conductor is mounted on each elastic element for conjoined movement therewith so as to engage electrically with two pairs of the three pairs of conductive shoes. The elastic element biases the conductor to engage with the conductive shoes.

2 Claims, 3 Drawing Sheets

POSITIONING STRUCTURE FOR A SLIDING TYPE SWITCH ASSEMBLY

BACKGROUND OF THE INVENTION

1. Field of the Invention

The present invention relates to a positioning structure for a sliding type switch assembly.

2. Description of the Related Art

U.S. Pat. No. 5,532,442 to Applicant discloses a sliding type switch which has a slidable knob for actuating the switches. Nevertheless, it is found that the conductors 33 cannot be easily aligned during assembly. In addition, the spring element 30 tends to displace in the non-conductive slide member 20, such that uniform distribution of stress cannot be obtained when the spring element 30 is subjected to a force. The present invention is intended to provide an improved sliding type switch assembly with a positioning structure to solve this problem.

SUMMARY OF THE INVENTION

A sliding type switch in accordance with the present invention includes a non-conductive housing enclosing a chamber and including a flange extending along a mediate portion of an inner periphery thereof, thereby separating the chamber into an upper portion and a lower portion. The housing further includes a first slot defined in a bottom thereof.

A non-conductive board is securely mounted in the upper portion of the chamber and includes at least three pairs of second slots defined therein. At least three pairs of conductive prongs respectively extend through the second slots in the board, each conductive prong having a conductive shoe formed at a bottom thereof.

A non-conductive slide member is slidably mounted in the lower portion of the chamber and has a knob extending through the first slot. The knob is slidably movable in the first slot for selectively positioning the slide member within the chamber. The slide member further defines two elongated troughs in which an inner bottom wall defining each elongated trough has a stub formed thereon.

An elastic element is mounted in each trough and includes a mediate portion with a hole defined therein through which the associated stub extends for positioning the elastic element, and a first limb and a second limb which extend upwardly from the mediate portion and away from each other.

At least one conductor is mounted on each elastic element for conjoined movement therewith so as to engage electrically with two pairs of the three pairs of conductive shoes. The elastic element biases the conductor to engage with the conductive shoes.

Preferably, the conductor is substantially inverted U-shaped and includes two downwardly extending ends for respectively bearing against the first and second limbs of the associated elastic element from outer sides of the first and second limbs.

Other objects, advantages, and novel features of the invention will become more apparent from the following detailed description when taken in conjunction with the accompanying drawings.

DESCRIPTION OF THE PREFERRED EMBODIMENT

Figure 1:
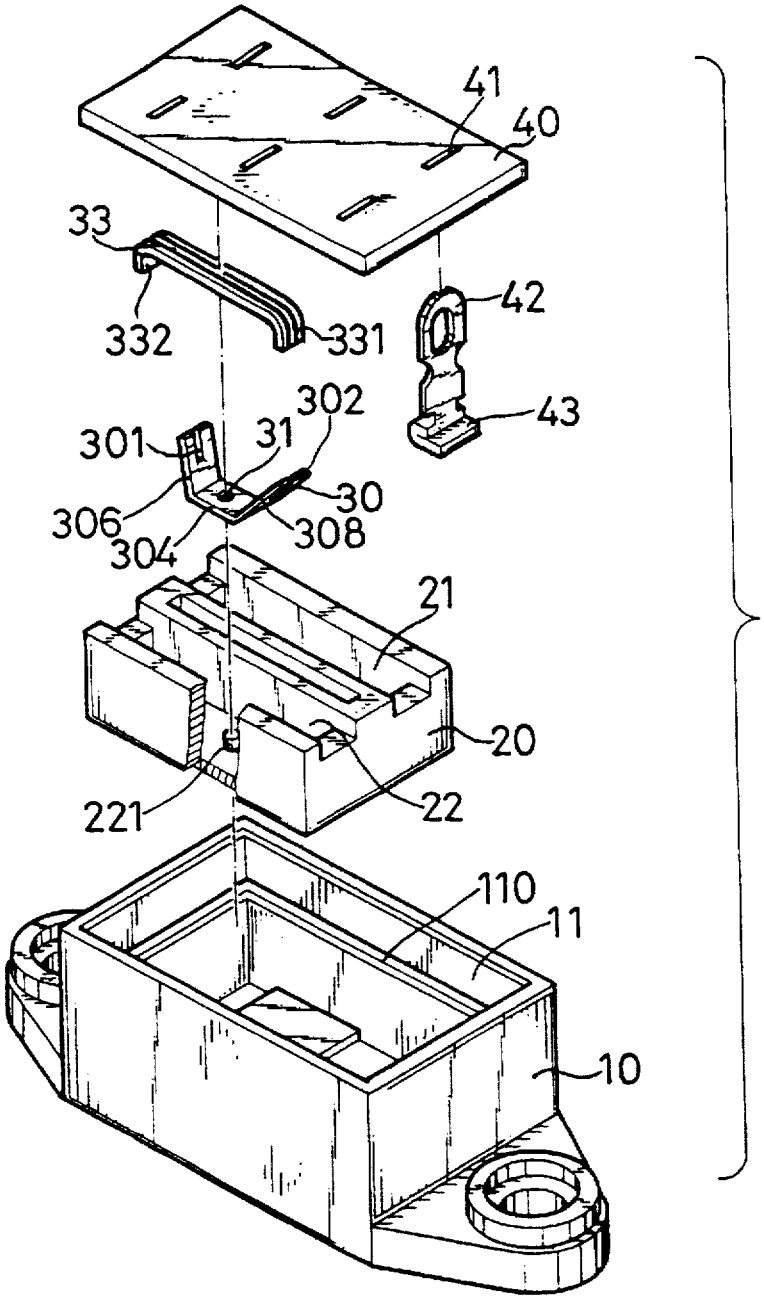
FIG. 1 is an exploded perspective view of a sliding type switch assembly in accordance with the present invention.
Figure 6:
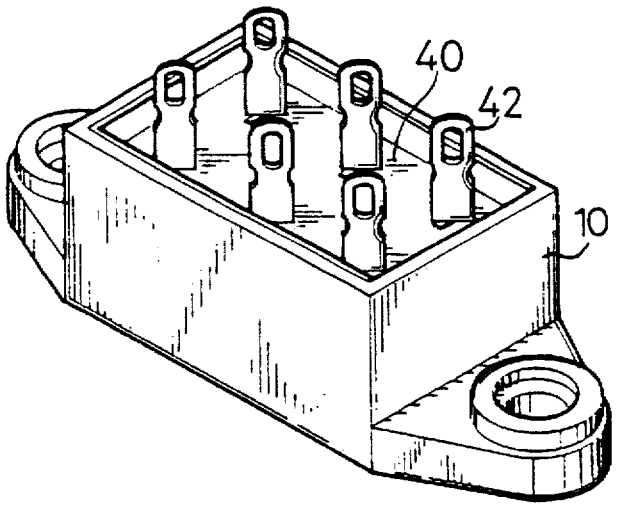
FIG. 6 is a perspective view of the sliding type switch assembly in accordance with the present invention.

Referring to the drawings and initially to FIGS. 1 and 6, a sliding type switch assembly in accordance with the present invention generally includes a non-conductive housing 10 enclosing a chamber 11 and including a flange 110 extending along a mediate portion of an inner periphery thereof, thereby separating the chamber 11 into an upper portion and a lower portion. The housing 10 further comprises a first slot 101 defined in a bottom thereof (see FIG. 2).

Figure 2:
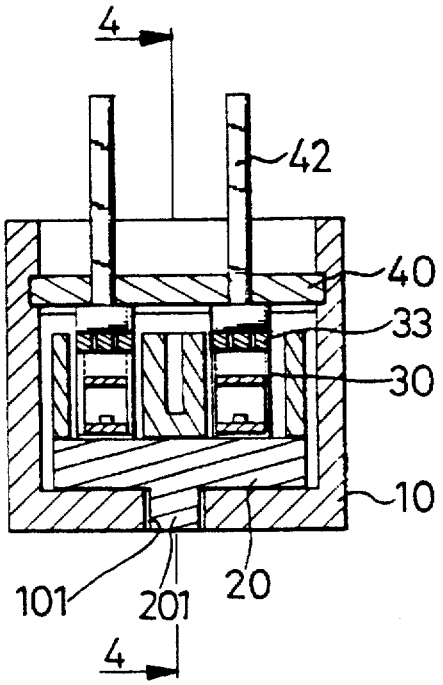
FIG. 2 is a cross sectional view, taken along line 2—2 in FIG. 4, of the sliding type switch assembly in accordance with the present invention.
Figure 4:
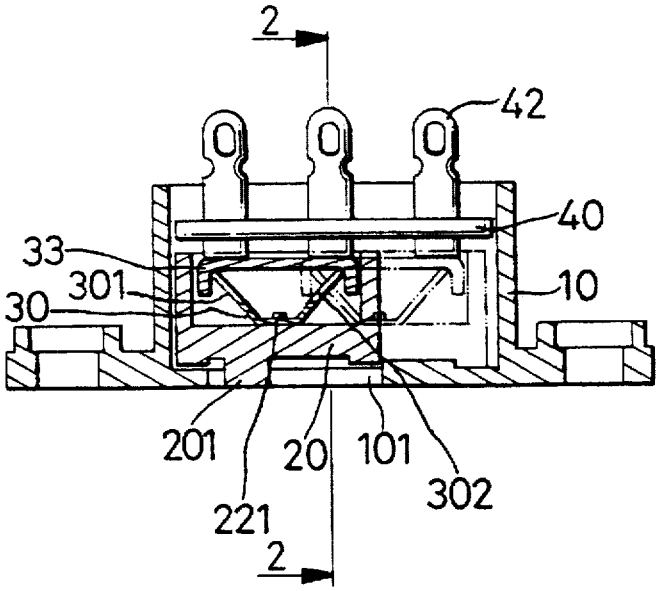
FIG. 4 is a cross sectional view taken along line 4—4 in FIG. 2.

As shown in FIGS. 2 and 4, a non-conductive board 40 is securely mounted in the upper portion of the chamber 11 and includes at least three pairs of second slots 41 (see FIG. 1) defined therein. At least three pairs of conductive prongs 42 respectively extend through the second slots 41 in the board 41. Each conductive prong 42 has a conductive shoe 43 formed at a bottom thereof, as shown in FIG. 1.

A non-conductive slide member 20 is slidably mounted in the lower portion of the chamber 11 and has a knob 201 extending through the first slot 101. The knob 201 is slidably movable in the first slot 101 for selectively positioning the slide member 20 within the chamber 11. The slide member 20 further defines two elongated troughs 21 and 22 in which an inner bottom wall defining each elongated trough 21, 22 has a stub 221 (see FIGS. 1 and 4) formed thereon.

An elastic element 30 is mounted in each trough and includes a mediate portion 304 with a hole 31 defined therein through which the associated stub 221 extends for positioning the elastic element 30. Each elastic member further includes a first limb 306 and a second limb 308 which extend upwardly from the mediate portion 304 and away from each other. Each of the first limb 306 and the second limb 308 has a notch 301, 302 defined therein.

Figure 3:
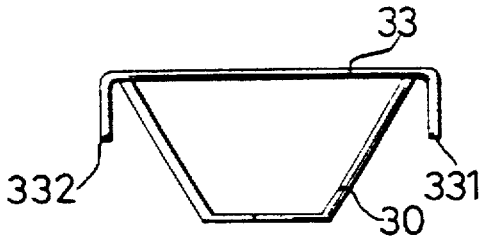
FIG. 3 is an enlarged side elevational view illustrating engagement between a positioning element and a conductor of the sliding type switch assembly.

At least one conductor 33 is mounted on each elastic element 30 for conjoined movement therewith so as to engage electrically with two pairs of the three pairs of conductive shoes 43. The elastic element 30 biases the conductor 33 to engage with the conductive shoes 43 (see FIG. 4). In a preferred embodiment of the present invention, the conductor 33 is substantially inverted U-shaped and includes two downwardly extending ends 331 and 332 for respectively bearing against the first and second limbs 306 and 308 of the associated elastic element 30 from outer sides of the first and second limbs 306 and 308, as shown in FIGS. 3 and 4. By such an arrangement, a force applied to the elastic elements 30 can be imparted to the mediate portions 304 thereof, thereby resulting in a uniformly distributed stress. It is appreciated that the elastic elements 30 are securely positioned in the associated trough 21, 22. Accordingly, undesired displacement of the elastic elements 30 is prevented.

Figure 5:
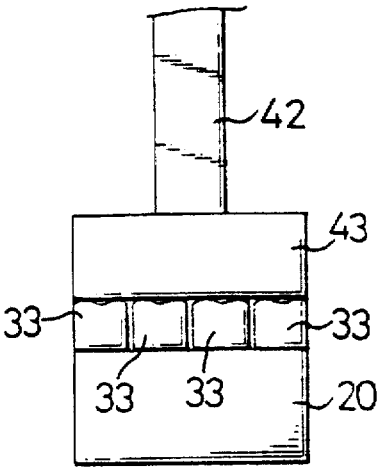
FIG. 5 is an enlarged schematic side elevational view illustrating contact between the conductors and a prong of the sliding type switch assembly.

In an embodiment of the present invention, the sliding type switch assembly in FIG. 5 may include four conductors 33 which provides a reliable contact with the conductive shoes 43.

Although the invention has been explained in relation to its preferred embodiment, it is to be understood that many, other possible modifications and variations can be made without departing from the spirit and scope of the invention as hereinafter claimed.

What is claimed is:

1. A sliding type switch comprising:

a non-conductive housing enclosing a chamber and including a flange extending along a mediate portion of an inner periphery thereof, thereby separating the chamber into an upper portion and a lower portion, the housing further comprising a first slot defined in a bottom thereof;

a non-conductive board securely mounted in the upper portion of the chamber and including at least three pairs of second slots defined therein;

at least three pairs of conductive prongs respectively extending through the second slots in the board, each said conductive prong having a conductive shoe formed at a bottom thereof;

a non-conductive slide member slidably mounted in the lower portion of the chamber and having a knob extending through the first slot, the knob being slidably movable in the first slot for selectively positioning the slide member within the chamber, the slide member further defining two elongated troughs in which an inner bottom wall defining each said elongated trough has a stub formed thereon;

an elastic element mounted in each said trough and including a mediate portion with a hole defined therein through which the associated stub extends for positioning the elastic element, and a first limb and a second limb which extend upwardly from the mediate portion and away from each other;

at least one conductor mounted on each said elastic element for conjoined movement therewith so as to engage electrically with two pairs of the three pairs of conductive shoes, the elastic element biasing said at least one conductor to engage with said conductive shoes.

2. The sliding type switch assembly according to claim 1, wherein said at least one conductor is substantially inverted U-shaped and includes two downwardly extending ends for respectively bearing against the first and second limbs of the associated elastic element from outer sides of the first and second limbs.

* * * * *